US010196760B2

(12) United States Patent
Vetterli et al.

(10) Patent No.: US 10,196,760 B2
(45) Date of Patent: Feb. 5, 2019

(54) FASTENING DEVICE FOR COMB ELEMENTS ON A CIRCULAR COMB

(71) Applicant: Graf + Cie AG, Rapperswil (CH)

(72) Inventors: Arnold Vetterli, Dübendorf (CH); Markus Schilter, Feusisberg (CH); Urs Müller, Euthal (CH); Urs Schiltknecht, Stäfa (CH)

(73) Assignee: Graf + Cie AG, Rapperswil (CH)

( * ) Notice: Subject to any disclaimer, the term of this patent is extended or adjusted under 35 U.S.C. 154(b) by 203 days.

(21) Appl. No.: 15/261,906

(22) Filed: Sep. 10, 2016

(65) Prior Publication Data

US 2017/0073848 A1 Mar. 16, 2017

(30) Foreign Application Priority Data

Sep. 11, 2015 (CH) ..... 01318/15

(51) Int. Cl.
*D01G 19/10* (2006.01)
*D01G 15/92* (2006.01)
*D01G 15/88* (2006.01)

(52) U.S. Cl.
CPC ..... *D01G 19/105* (2013.01); *D01G 15/88* (2013.01); *D01G 15/92* (2013.01)

(58) Field of Classification Search
CPC ..... D01G 15/92; D01G 19/105
See application file for complete search history.

(56) References Cited

U.S. PATENT DOCUMENTS 865,512 A 9/1907 Mellor
4,414,710 A * 11/1983 Bolen ..... D01G 15/40 19/105

(Continued)

FOREIGN PATENT DOCUMENTS

BE 385519 A 11/1932
CH 706 344 A2 10/2013

(Continued)

OTHER PUBLICATIONS

Swiss Search Report, dated Oct. 29, 2015.

*Primary Examiner* — Shaun R Hurley
(74) *Attorney, Agent, or Firm* — Dority & Manning, P.A.

(57) ABSTRACT

A circular comb of a combing machine has a base body oriented parallel to a rotational axis of the circular comb, the base body including an inner support surface and a radially oriented opening. A comb element is disposed on an outer circumference of the base body, and a retaining element having a threaded bore is connected to the comb element. A threaded bolt has a threaded first section that engages into the threaded bore, a middle section that protrudes through the radially oriented opening the in base body, and a second end section supported on the inner support surface of the base body. A spring element is configured with the middle section of the fastening element and includes a first end supported on a support surface of the second end section of the fastening element, and a second end supported on the support surface of the base body. In one embodiment, the retaining element comprising a detent point into which the first end section of the fastening element is transferred by a longitudinal displacement of the fastening element against an elastic force of the spring element.

15 Claims, 4 Drawing Sheets

(56) References Cited

U.S. PATENT DOCUMENTS 4,716,629 A * 1/1988 Iwata ..... D01G 19/105 19/114
4,947,520 A * 8/1990 Hollingsworth ..... D01G 15/20 19/105
5,016,321 A * 5/1991 Hollingsworth ..... B65H 54/80 19/105
5,113,559 A * 5/1992 LaRoche ..... D01H 4/32 19/112
5,461,808 A * 10/1995 Fritts ..... G09F 13/04 362/278
5,797,788 A 8/1998 Graf et al.
6,047,621 A * 4/2000 Dries ..... B21D 28/34 83/136
6,077,011 A * 6/2000 Walker ..... F16B 21/165 24/453
6,101,805 A * 8/2000 Wassenhoven ..... C04B 35/565 19/112
9,145,626 B2 9/2015 Müller
2011/0272548 A1* 11/2011 Rudkowski ..... F16B 5/121 248/231.81
2012/0102714 A1* 5/2012 Scheinberger ..... F16B 19/1063 29/509
2013/0263408 A1* 10/2013 Muller ..... D01G 19/105 19/234
2015/0167203 A1* 6/2015 Shimbara ..... D01G 19/105 19/233
2017/0073847 A1* 3/2017 Vetterli ..... D01G 19/105

FOREIGN PATENT DOCUMENTS

CN 2069418 U 1/1991
CN 102864526 B 1/2015
CN 104790073 A 7/2015
DE 33 36 876 A1 4/1985
EP 0 790 099 8/1997
EP 2 650 414 A1 10/2013

* cited by examiner

Fig.3a (section A-A)

Fig.9 (section B-B)

FASTENING DEVICE FOR COMB ELEMENTS ON A CIRCULAR COMB

FIELD OF THE INVENTION

The invention relates to a circular comb of a combing machine.

BACKGROUND

A design is known from DE 33 36 876 A1 in which the comb elements for a circular comb are made up of multiple toothed segments which are provided with a toothed clothing and held together by longitudinal bolts. The longitudinal bolts protrude into boreholes provided in the toothed segments. Multiple comb elements arranged one behind the other (also referred to as a bar) form a comb segment having a closed combing surface. The toothed segments of the particular comb element are provided with a dovetail-shaped recess via which they are connected to a base body of the circular comb by means of a retaining member. The retaining member is provided with a corresponding dovetail-shaped counterprofile, via which it engages with the recess in the toothed segments and is held in a corresponding recess in the base body via a screw connection.

A similar design is known from published CH 706 344 A2, in which toothed clothings are fastened to a retaining rod that is connected to a base body via dovetail-shaped fastening means. Here as well, a screw connection is provided via which the fastening means is connected to the base body. In practice, maximum torques are specified for tightening the screws, via which the retaining members, i.e., the retaining rods for fastening the comb elements to the base body, are connected or braced. The aim of specifying a maximum torque is to prevent the comb elements from warping when they are braced against the outer circumferential surface of the base body during the fastening operation. These specifications may also be met by using a torque wrench, so that no warping occurs in the comb elements, which could result in dimensional deviation and influence the distance of the tooth tips of the comb clothings from the lower nipper plate of a nipper unit. In practice, however, it has been shown that in many cases a torque wrench is not used, and these screws are tightened with a simple wrench, resulting in the above-described risk of tightening the screws with a higher torque than specified. This may result in the described deformations of the comb clothings, which may adversely affect a distance to be maintained between the lower nipper plate and the tooth tips. In the worst case, this may result in collisions between the tooth tips of the clothings and the lower nipper plate.

SUMMARY OF THE INVENTION

An object of the invention, therefore, is to propose a device by which the described disadvantages of known designs are avoided, and warping of the comb elements during fastening to the base body of the circular comb is precluded, and rapid replacement is made possible. Additional objects and advantages of the invention will be set forth in part in the following description, or may be obvious from the description, or may be learned through practice of the invention.

The objects are achieved on the one hand in that it is proposed that the middle section of the fastening element bears at least one spring element, which with a first end is supported on a support surface of the second end section of the fastening element facing the middle section, and with its second end is supported on the oppositely situated support surface of the base body, and the retaining element has a detent point for the first end section of the fastening element, into which the first end section of the fastening element is transferable by a longitudinal displacement of the fastening element by overcoming the elastic force of the spring element.

With the proposed device it is possible to fasten the comb elements to the outer circumference of a base body without the risk of the comb elements becoming warped during the fastening operation. That is, the contact force of the particular comb element on the outer circumference of a base body of a circular comb is provided solely via the elastic force which is built up or generated during installation due to a longitudinal displacement of the particular fastening element into a detent position.

It is preferably further proposed that the retaining element is designed, at least partially, as a hollow body having a web that is situated opposite from the base body and that is provided with at least one through opening having an elongated cross section, and whose outer cross-sectional shape corresponds to the largest cross-sectional shape of the first end section, the cross-sectional area of the through opening extending beyond the cross-sectional area of the largest cross-sectional shape of the first end section of the fastening element, and receptacles being provided within the hollow body in the area of the web, which are offset at an angle of rotation with respect to the longitudinal direction of the through opening and which form a detent position for the first end section of the fastening element.

The fastening element may thus be transferred into a locking position within the retaining element, designed as a hollow body, without a special tool. The detent position of the fastening means may be provided by simply rotating it into the receptacles within the hollow body, which are offset at an angle of rotation. Rapid assembly and disassembly is thus possible, and the fixing of the fastening elements in the installed position is ensured.

To ensure ease of threading the particular fastening means through the opening in the base body, it is further proposed that the cross-sectional area of the opening in the base body extends beyond the largest cross-sectional area of the first end section.

Moreover, it is proposed that the middle section is provided with a radially outwardly extending collar whose outer diameter is such that the fastening element is captively held in the base body. This ensures that during disassembly of the particular comb element, the fastening elements are held in the opening in the base body and cannot fall through same in the direction of the circular comb shaft. That is, the fastening elements remain in a position in which they are ready for rapid installation of a new comb element.

It is advantageous for the fastening element to be made at least partially of plastic. Thus, on the one hand the collar is able to yield slightly in the radial direction for securing of the fastening element when it is first passed through the opening in the base body. On the other hand, the fastening elements thus have a low weight, which is advantageous with regard to the mass of the circular comb to be accelerated.

Objects of the invention are likewise achieved in that it is proposed that the retaining element is designed as a hollow body having a web that is situated opposite from the base body, and which is provided with a through opening into which the fastening element protrudes with its middle section, which bears at least one spring element which with a first end is supported on a support surface of the first end section of the fastening element facing the middle section, and which is supported with its second end on a support surface of the web situated within the hollow profile, and the second end section of the fastening element has retaining means which fix the second end section of the fastening element in a locking position with respect to the support surface of the base body, in which the second end section is transferred against the elastic force of the spring element due to a longitudinal displacement of the fastening element.

With this approach as well, due to a simple longitudinal displacement of the particular fastening element against an elastic force, it is possible to transfer the fastening element into a locking position in which it is easily fixed. In this locking position, the comb element is pressed onto the outer circumference of a base body solely via the compressed spring element.

To easily hold the fastening element in the transferred locking position, it is proposed that the retaining means is made up of elements that are detachably connected to the second end section of the fastening means, and which at least partially extend beyond the cross-sectional area of the opening in the base body.

It is advantageous when the second end section of the fastening means is designed as a threaded bolt whose outer diameter is smaller than the diameter of the adjoining middle section, and the retaining means is a threaded nut. Simply by screwing the threaded nut onto the proposed threaded bolt, it is possible to achieve a longitudinal displacement of the fastening element for tensioning the inserted spring element. Overtightening of the threaded nut is avoided, since due to the proposed difference in diameters of the middle section and the threaded bolt, the threaded nut comes to rest on the shoulder of the middle section when it is screwed onto the threaded bolt.

An approach for fixing the fastening means in the locking position is likewise possible, in that it is proposed that the second end section of the fastening means has depressions or openings in the circumferential direction in which the retaining means engage.

The proposed spring elements may be designed as coil springs or as wave springs.

In order to position the retaining elements, and thus the comb elements, on the base body during installation, with regard to both embodiment variants, it is further proposed that the base body has recesses into which the particular retaining element protrudes in the radial direction.

To ensure a secure and defined seating of the particular comb element on the base body, it is further proposed that the base body, viewed in the circumferential direction of the circular comb, is provided with support ribs, situated at a distance from one another, on which the end areas of the particular comb elements rest, the support ribs extending in parallel to a rotation axis of the circular comb.

The retaining elements for both proposed approaches are preferably made at least partially of plastic. The mass of the circular comb to be accelerated may thus be kept low. Cost-effective manufacture of the retaining elements is likewise made possible.

As a further variant, it is proposed that the retaining element is joined in one piece to the comb element.

A combing machine is preferably equipped with at least one circular comb having the fastening of the comb elements claimed according to the invention.

BRIEF DESCRIPTION OF THE FIGURES

Further advantages of the invention are shown and described in greater detail with respect to the following exemplary embodiments.

FIG. 3*a* shows a sectional illustration A-A according to FIG. 3;

FIG. 9 shows a sectional illustration B-B according to FIG. 8.

DETAILED DESCRIPTION

Figure 1:
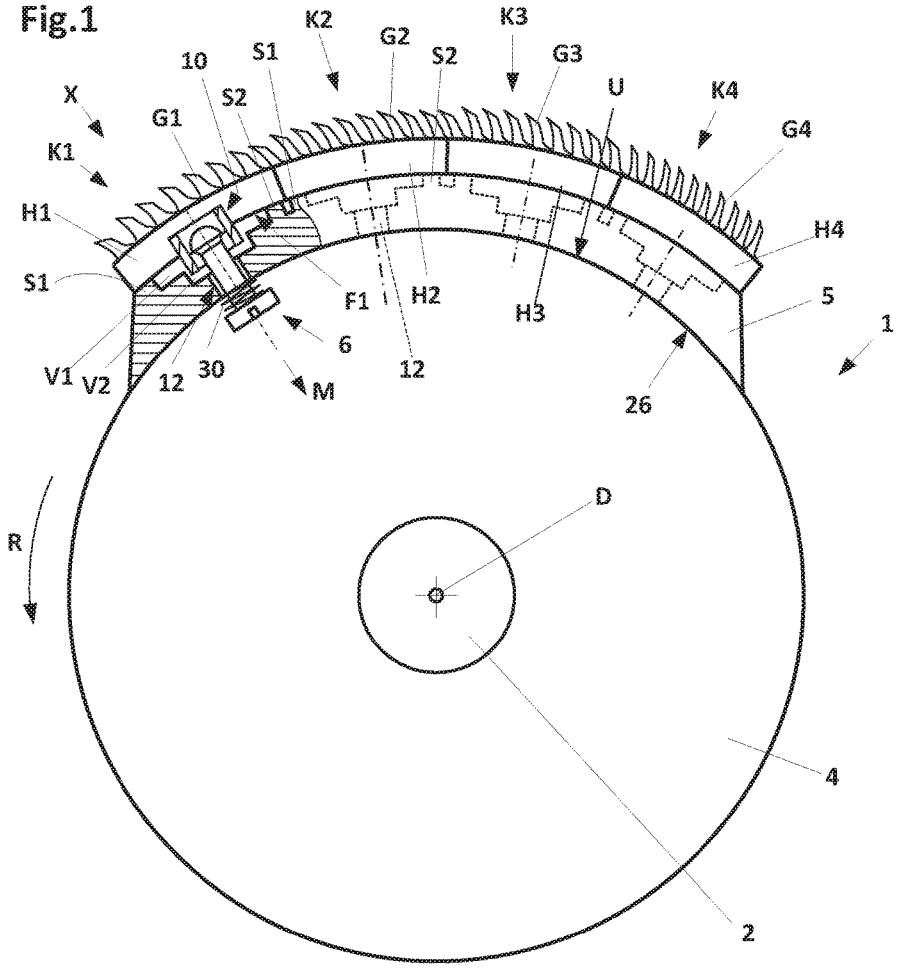
FIG. 1 shows a schematic side view of a circular comb of a combing machine, with fastening, designed according to the invention, of a comb element.

Reference will now be made to embodiments of the invention, one or more examples of which are shown in the drawings. Each embodiment is provided by way of explanation of the invention, and not as a limitation of the invention. For example features illustrated or described as part of one embodiment can be combined with another embodiment to yield still another embodiment. It is intended that the present invention include these and other modifications and variations to the embodiments described herein.

Figure 2:
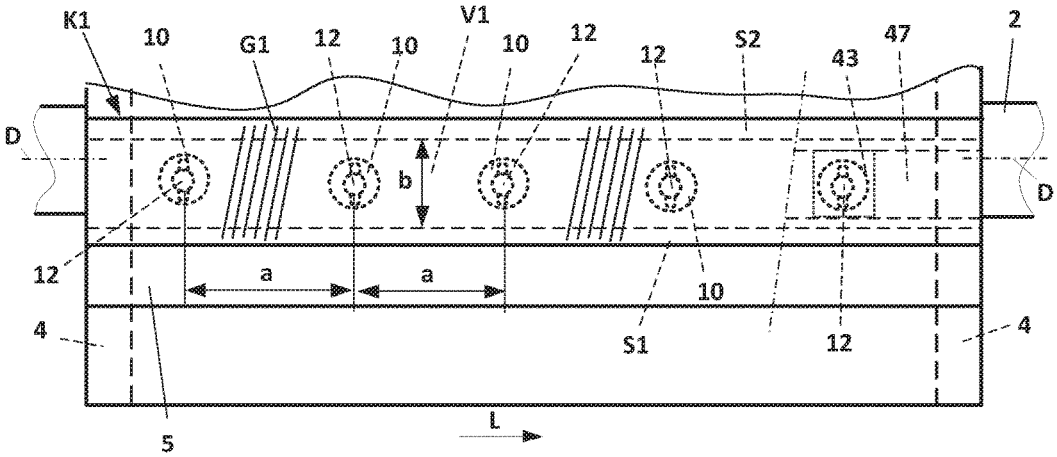
FIG. 2 shows a top view X according to FIG. 1.

FIG. 1 shows a circular comb 1, having a circular comb shaft 2 on which two flanges 4 are mounted at a distance from one another in a rotatably fixed manner. This is also particularly apparent from the partial view X according to FIG. 1, shown in FIG. 2. A base body 5 is fastened to a partial circumference of the flange 4, and on its circumferential surface U the base body bears multiple comb elements K1 to K4 situated one behind the other. In the present example, the comb elements K1-K4 have a retaining rod H1-H4 to which clothing elements G1-G4 are respectively fastened. The clothing elements G1-G4 may be fastened to the respective retaining rods H1-H4 via a laser-welded seam, for example, as shown and described in published EP 2650414 A1. However, other types of fastenings are also possible.

Figure 3:
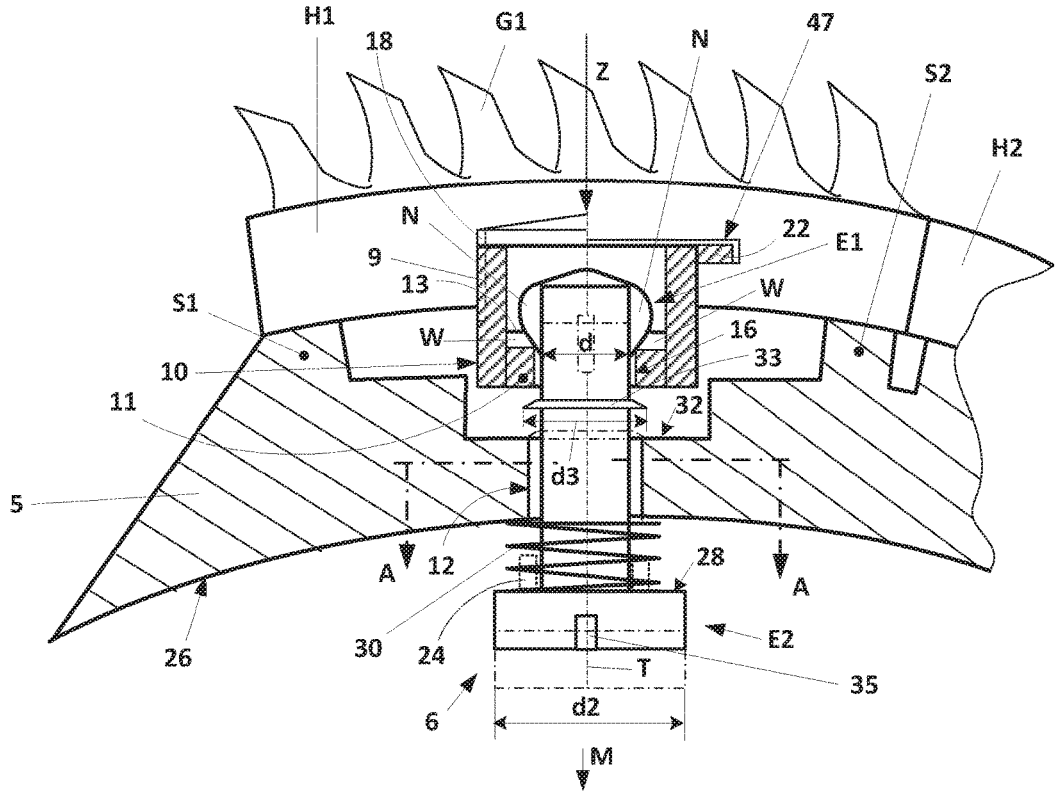
FIG. 3 shows an enlarged partial view according to FIG. 1.
Figure 3:
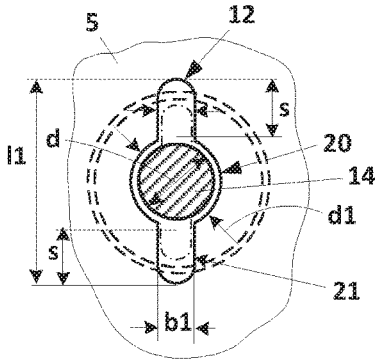

One exemplary embodiment according to the invention of the fastening of the front comb element K1 is shown in FIG. 1, and in an enlarged partial view in FIG. 3. The other comb elements K2 to K4 may be connected to the base body 5 in the same way, as indicated by dashed lines in FIG. 1. In the support area of the comb elements K1-K1 [sic; K4], the base body 5 is provided in each case with a first depression V1 which extends in parallel to a rotation axis D of the circular comb shaft 2. This depression V1 is formed by two support ribs S1, S2 which are situated at a distance b from one another and which extend in a longitudinal direction L of the comb elements K1-K4, i.e., in parallel to the rotation axis D, as is also apparent from the top view X (according to FIG. 1) in FIG. 2. The retaining rod H1 of the comb element K1 with its base area F1 is supported on these support ribs S1, S2 in the installed position. Further circular depressions V2, which are situated at a distance a from one another and into which retaining elements 10 at least partially protrude, are provided in the area of the first depression V1. A through opening 12 which is provided with a cross-sectional area that differs from a circular area opens into the particular depression V2 in order to partially pass through a fastening element, in the form of a bar-shaped bolt 6, during installation of the particular comb element, as described below. The cross-sectional shape of the through opening 12 is apparent from the sectional illustration A-A (according to FIG. 3) shown in FIG. 3*a*. The cross-sectional area of the through opening 12 has a central circular region 20 having a diameter d1, and an elongated hole-shaped region 21 which extends over the midpoint of the circular region 20. The elongated hole-shaped region 21 (elongated hole for short), having a length 11 and a width b1, extends with its longitudinal sides beyond the diameter of the circular region 20 on two sides by an amount s. The narrow side of the elongated hole 21 having the width b1 is smaller than the diameter d1 of the circular region 20. The cross-sectional area of the through openings 12, which is also schematically shown in FIG. 2, allows a first end section E1 of the bar-shaped bolt 6 to be passed through. As is likewise apparent from FIG. 2, multiple through openings 12 having a spacing a, viewed in the longitudinal direction L, are provided, through which bolts 6 for fastening the comb element K1 are passed through.

The largest cross-sectional shape of the first end section E1 of the bolt 6 corresponds approximately to the cross-sectional shape of the through opening 12, there being a small distance between the inner contour of the through opening 12 and the outer contour of the largest cross-sectional area of the first end section E1 of the bolt 6 when the first end section E1 is passed through the through opening 12.

Figure 4:
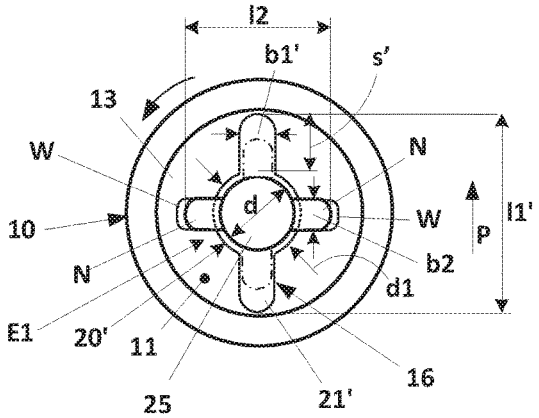
FIG. 4 shows a top view A of the retaining element according to FIG. 3.

As is apparent from the partial view Z (according to FIG. 3) in FIG. 4, the end section E1 has a cylindrical section with a circular cross-sectional area 25 having a diameter d, this cylindrical section being provided with outwardly protruding ribs N on two opposite sides. The external dimension 12 constituted by the two ribs N is smaller than the length dimension 11' of the elongated hole-shaped cross-sectional region 21' (elongated hole for short) of a through opening 16 in a web 11 of the retaining element 10, which has a central, circular cross-sectional region 20'. The elongated hole-shaped cross-sectional region 21' extends beyond the circular cross-sectional region on both sides by the dimension s', and has a width b1' that is smaller than the diameter d1' of the circular cross-sectional region 20'. The ribs N have a width b2 that is smaller than the width b1' of the narrow side of the elongated hole 21'. Due to the provided dimensions of the first end section E1 of the bolt 6 and of the through opening 16, it is possible to pass this end section E1 through the through opening 16 during installation, as described in greater detail below.

The through openings 12 and the through openings 16 have essentially the same cross-sectional area, and therefore the same reference numerals are used. As is apparent from FIGS. 3 and 4, the web 11 of the retaining element 10 is provided on its inner surface 13 with two detent points in the form of elongated hole-shaped receptacles W, which fix the ribs N in the installation position shown.

The receptacles W are angularly offset by 90° with respect to the elongated hole-shaped cross-sectional region of the through opening 16.

In the present example, the retaining element 10 (FIG. 3) in the installed position shown is detachably connected to the retaining rod H1. As is apparent from FIG. 3, two different types of fastening of the retaining element 10 are shown. In the illustration on the left side of the retaining element, the retaining element 10 is provided with an external thread 9, via which the retaining element is screwed into an internal thread 18 provided in the retaining rod H1. In the second approach shown on the right side of the retaining element 10, the retaining element is provided with an outwardly protruding flange 22 which is guided in a longitudinal slot 47 in the retaining rod H1. The flange 22 may have a square or rectangular shape, as schematically indicated on the right side in the illustration in FIG. 2, for example. During preassembly of the comb element K1, the appropriate number of retaining elements 10 are inserted through the flange 22 into the longitudinal slot 47, and positioned at the provided location (see FIG. 2).

The first end section E1 of the bolt 6 is adjoined by a cylindrical middle section 14, whose diameter d corresponds to the diameter of the circular cross-sectional area 25 of the end section E1. In the installation position shown in FIG. 3, this middle section 14 protrudes through the two through openings 12 and 16. On the opposite side of the end section E1, the bolt 6 has a second end section E2 which adjoins the middle section 14. This end section E2 is situated below an inner support surface 26 of the base body 5, and has a diameter d2 which extends beyond the diameter d of the middle section 14.

A spring element 30 is supported between a support surface 28 of the end section E2 and the inner support surface 26 of the base body 5, and is tensioned in the position shown. The spring element is shown here as a coil spring 30. However, it is also possible to use a wave spring 31 instead of the coil spring 30, as shown in another exemplary embodiment in FIG. 8.

As schematically indicated in FIG. 3, guide elements 24 may be provided in the area of the support surface 28 in order to center the spring element 30 with respect to the middle section 14.

Between the end sections E1 and E2, the middle section 14 has a collar 33 whose outer diameter d3 is slightly larger than the diameter d1 of the circular cross section 20 of the through opening 12. The difference between the diameters d3 and d1 need only be great enough to hold the particular bolts in the base body 5 when the comb elements K1-K4 are uninstalled.

The bolts 6 may preferably be made of plastic. During initial installation of the bolt 6, in which the collar 33 is passed through the through opening 12, the outer edge of the collar is thus able to elastically yield inwardly. After it is passed through the through opening 12, the collar once again assumes its original shape, thereby captively holding the fastening element, i.e., the bolt, in the base body 5.

According to the exemplary embodiment according to FIG. 3, the fastening of the comb element K1 on the base body 5 of the circular comb 1 takes place as follows: After an appropriate number of retaining elements 10 (corresponding to the described approaches) have been fastened to or positioned on the retaining rod H1 of the comb element K1, as previously described, the retaining rod H1 is mounted on the support ribs S1, S2 of the base body 5. The retaining rod H1 is positioned in such a way that the particular retaining elements 10 protrude into the respective depressions V2 provided for this purpose. For positioning the retaining elements 10, appropriate markings (not shown) may be provided on the retaining rod H1. The particular through opening 12 in the base body and the through openings 16 in the retaining elements 10 are now concentric with respect to one another. The bolts 6 are then inserted, by hand or using a tool, in the appropriate orientation relative to the extension of the cross-sectional area of the through opening 12, starting from the inner support surface 26 of the base body, through the through opening 12 and across the first end section E1. Prior to this step, the spring element 30 is also placed centrally on the support surface 28 of the second end section E2 with respect to the middle section 14 of the bolt 6. Upon further axial displacement of the bolt 6, the first end section E1 passes into the through opening 16 in the retaining element 10. At the same time, the spring element 30 with its second end comes to rest on the inner support surface 26 of the base body 5. Upon further axial displacement of the bolt, the distance between the support surfaces 28 and 26 decreases, thereby tensioning the spring element 30. A force M is thus generated which pulls the bolt in the direction of the rotation axis D. The axial displacement of the bolt is carried out until the first end section E1 has completely passed through the through opening 16, and the ribs N are situated above the inner surface 13 of the web 11. In this position, the bolt 6 is rotated about its center axis T by 90°, as the result of which the ribs N are positioned above the receptacles W. The bolt is then released, causing the bolt 6 to be moved in the direction of the rotation axis D of the circular comb due to the force M generated by the spring element 30. In the process, the ribs N of the first end section E1 are transferred into the receptacles W, which at the same time act as an end stop and block further axial displacement of the bolt. The particular retaining element 10 and the retaining rod H1 connected to the retaining element 10 are braced and positioned with a force M against the circumferential surface U of the base body via the tensioned spring element 30. Since the ribs N also assume a detent position in the receptacles W with respect to a rotation of the bolt, the fastening is prevented from coming loose on its own. The movement of the bolt in the axial direction and the rotation of the bolt for transferring it into the detent position may take place easily and quickly by hand by gripping the second end section E2. If necessary (depending on the elastic force of the spring element 30), an additional tool may also be used, for which a depression 35 into which the tool may be fitted is provided in the second end section E2. The comb element K1 is now held on the base body 5 solely by the generated elastic force of the spring element 30. Installation of the other comb elements K2-K1 [sic; K4] may also take place in a short period of time without a tool.

For replacement of the comb element K1, for example, the second end section E2 is pushed against the elastic force in the direction of the inner support surface 26 of the base body until the ribs N are situated above the receptacles W, and rotation of the bolt 6 is made possible. The bolt in this position is rotated by 90°, as the result of which the first end section E1 is pushed into the through opening and the lock is thus released. In this position, indicated by dashed lines in FIG. 3, the comb element K1 may be lifted off from the base body 5. As likewise indicated by dashed lines in FIG. 3, the collar 33 with its outer edge comes to rest on an outer support surface 32 of the base body 5, and secures the bolt 6 from falling out through the through opening 12.

In this retaining position, a new comb element K1 can be mounted, and fastened by an axial displacement of the bolt with subsequent rotation by 90°, as described above.

Figure 5:
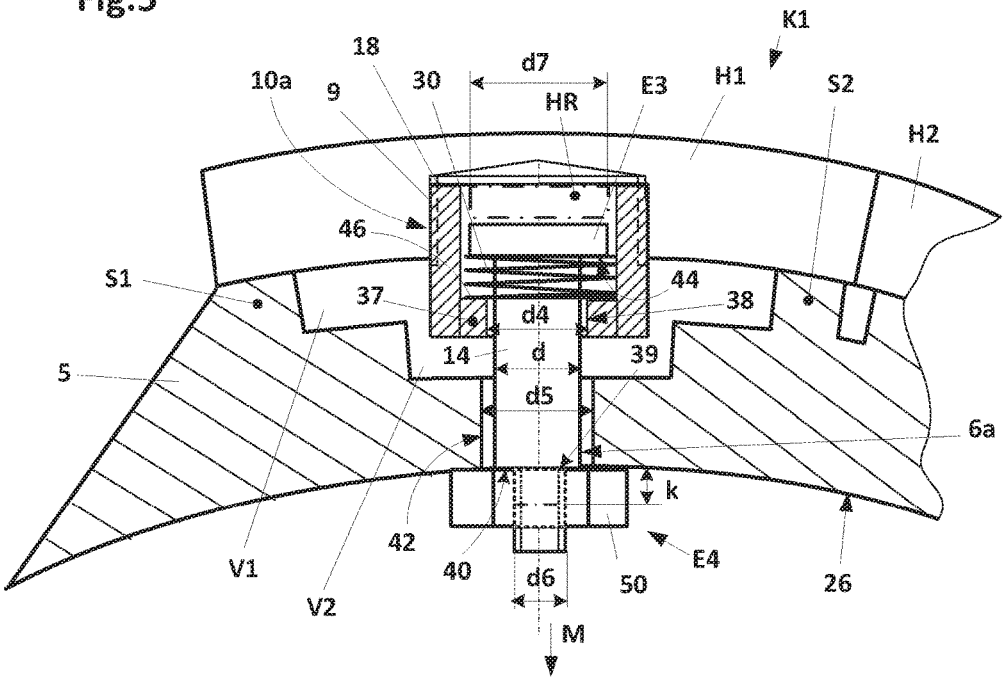
FIG. 5 shows an enlarged partial view, according to FIG. 1, of another exemplary embodiment.
Figure 6:
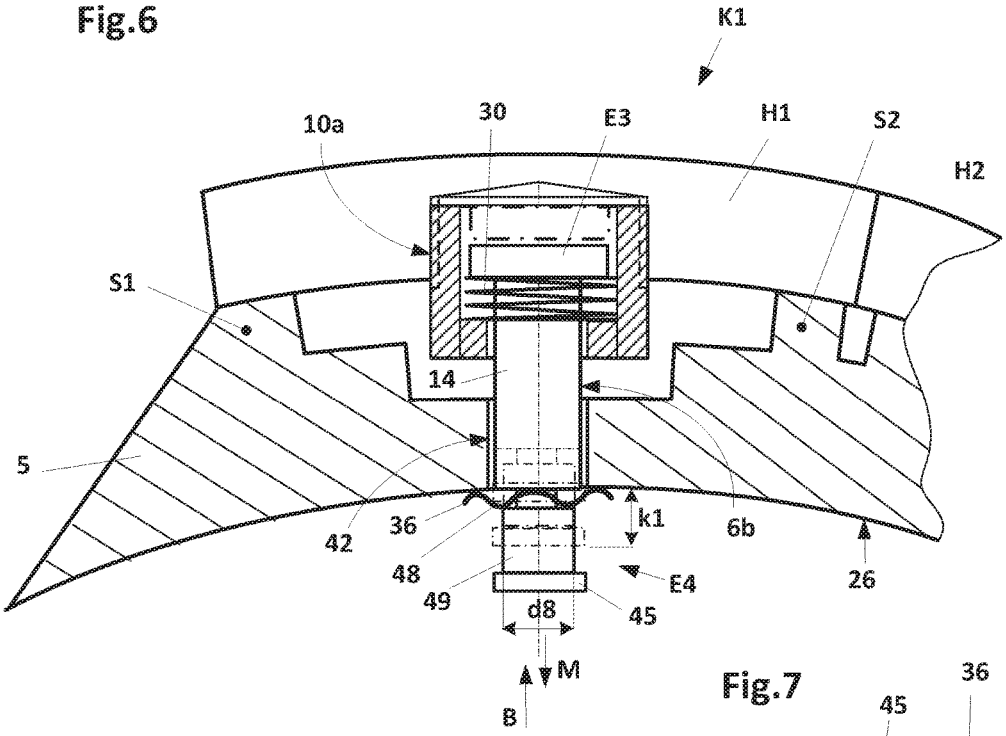
FIG. 6 shows another embodiment variant according to FIG. 5.
Figure 8:
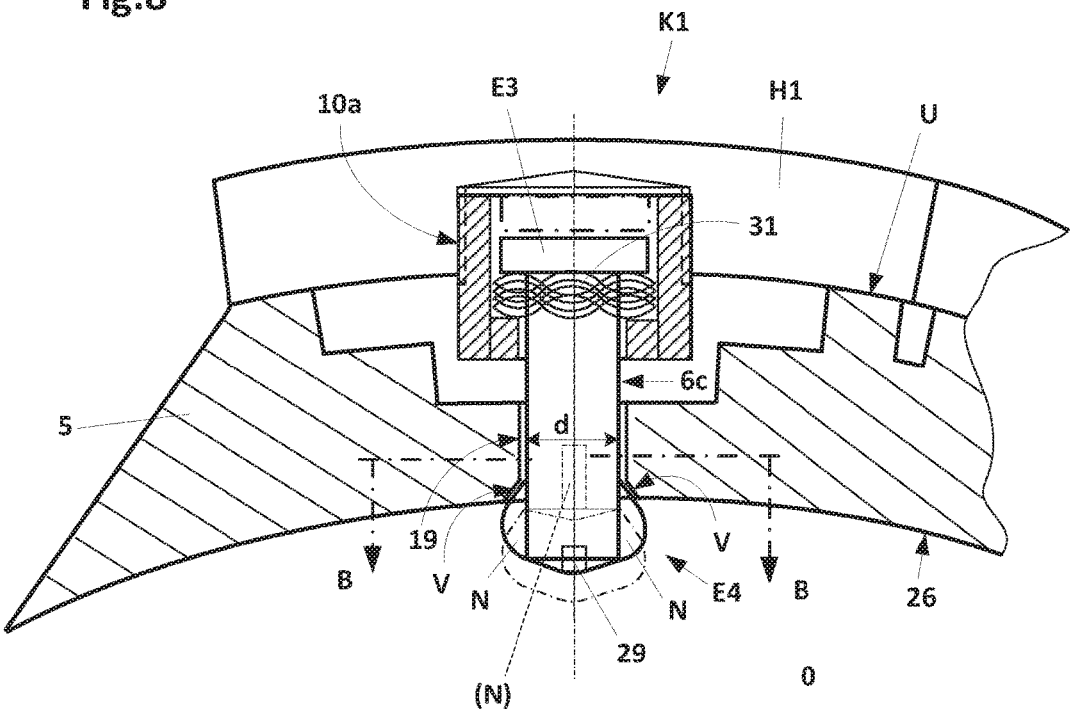
FIG. 8 shows an enlarged illustration according to FIG. 1 with another exemplary embodiment.
Figure 8:
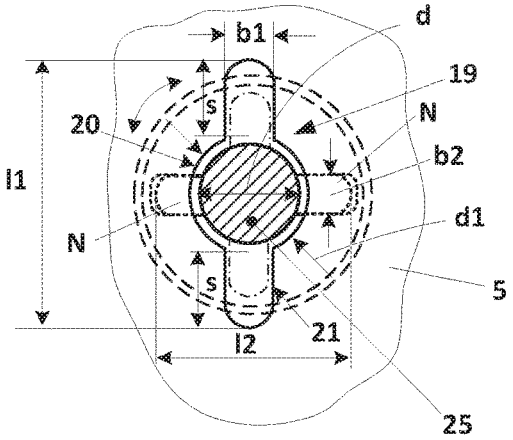

FIGS. 5, 6, and 8 show further exemplary embodiments of the invention, whereby, in contrast to the exemplary embodiment according to FIG. 3, the spring element 30 (31) which generates the contact force M is situated inside the particular retaining element 10. The contact force of the particular comb element K1-K4 is hereby also provided solely via the built-up elastic force M of the spring elements 30 (31) due to a longitudinal displacement of the particular bolt. With the exception of specially designed through openings, the design of the base body 5 corresponds to the design of the exemplary embodiment shown in FIG. 3.

In the exemplary embodiment in FIG. 5, a retaining element 10*a* has an external thread 9 via which it is screwed, i.e., detachably fastened, to the retaining rod H1 via an internal thread 18 provided on the retaining rod H1. Before the particular retaining element 10*a* is screwed to the retaining rod H1, a bolt 6*a* (fastening element) is inserted through a through opening 38 having a diameter d4. The through opening 38 into which a cylindrical middle section 14 of the bolt 6*a* protrudes is situated in a lower web 37 of the retaining element 10*a*. The bolt 6*a* has a second end section E4 designed as a threaded bolt having a diameter d6. The end section E4 is adjoined by the middle section 14, which has a diameter d that is larger than the diameter d6 of the threaded bolt of the second end section E4. A shoulder 39 having a surface 40 that extends beyond the threaded bolt is thus formed. In the installed position shown, the middle section 14 protrudes through a further through opening 42 in the base body 5 which has a diameter d5 that is larger than the diameter d of the middle section 14. The diameter d4 of the through opening 38 in the web 37 is larger than the diameter d of the middle section 14. The middle section 14, which protrudes through the through opening 38 into a cavity HR in the retaining element 10*a*, is adjoined by a first end section E3 which is cylindrical and has a diameter d7 that extends beyond the diameter d of the middle section 14. This results in a shoulder having a support surface 44 for the end section E3.

A spring element 30 is situated between this support surface 44 and an inner support surface 46 of the web 37, concentrically with respect to the middle section 14, and with its ends is supported on these support surfaces in the installation position (as shown in FIG. 5).

The fastening of the comb element K1 according to the exemplary embodiment in FIG. 5 takes place as follows: A spring element 30 is pushed onto the bolt 6*a* on the middle section 14 until it comes to rest against the support surface 44 for the first end section E3. The bolt 6*a* with its second end section E4 is then passed through the through opening 38, starting from the cavity HR in the retaining element 10*a*, until the spring element 30 comes to rest on the inner support surface 46 of the retaining element 10*a*. The appropriate number of retaining elements 10*a* provided in this way are subsequently screwed into the internal thread 18 of the retaining rod H1. The preassembled comb element K1 is then mounted on the support ribs S1, S2 of the base body 5.

The retaining rod H1 is positioned in such a way that the particular retaining elements 10*a* protrude into the respective depressions V2 in the base body provided for this purpose. At the same time, the threaded bolt of the particular second end section E4 is passed through the through opening 42 and extends beyond the through opening 42, i.e., an inner support surface 26 of the base body 5, by the dimension k, as indicated by dashed lines. The first end section E3 is likewise still situated in a position indicated by dashed lines, in which the spring element 30 is not yet tensioned.

In a next step, a screw nut 50 is screwed onto the thread of the threaded bolt of the second end section E4. When the screw nut 50 is screwed on, it comes to rest against the support surface 26. The distance k increases upon further screwing. At the same time, the first end section E3 of the bolt 6*a* is pushed in the direction of the web 37, thus compressing and tensioning the spring element 30. The resulting force M pulls the retaining element 10*a*, and thus the retaining rod, in the direction of the rotation axis D of the circular comb 1 (see FIG. 1). The screw nut 50 is tightened until it reaches its end position in which it comes to rest on the surface 40 of the shoulder 39. Further overtightening of the screw nut 50 is thus precluded. The other comb elements K2-K4 are fastened in a corresponding manner. Disassembly of the individual comb elements K1-K4 takes place in the corresponding reverse sequence.

Rapid, easy assembly and disassembly of comb elements is also possible with this type of fastening. The comb elements which are on hand for the replacement may already be preassembled in advance with bolts 6*a* and retaining elements 10*a*. After the screw nuts 50 are loosened, it is thus possible to easily lift off the comb element to be replaced, mount the new comb element in place of the old one, and easily and quickly fasten it by screwing on the screw nuts 50. If necessary, a second screw nut may also be screwed on in order to secure the screw nut 50 on the threaded bolt.

Figure 7:
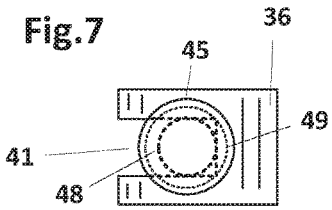
FIG. 7 shows a top view B of the fastening element according to FIG. 6.

The exemplary embodiment in FIG. 6 corresponds essentially to the exemplary embodiment in FIG. 5, and therefore only the differences are shown. In contrast to the exemplary embodiment in FIG. 5, the second end section E4 has a circumferential groove 48 which adjoins the middle section 14 of the bolt 6*b*. In addition, the groove 48, having the diameter d8, adjoins the inner diameter of the cylindrical retaining means 49 extending beyond the groove. A flange 45 whose diameter extends beyond the retaining means 49 is mounted on the end of the retaining means. The preassembly of the bolt 6*b*, the retaining element 10*a*, and the spring element 30 together with the retaining rod H1 of the comb element K1 takes place as in the exemplary embodiment in FIG. 5 described above. After the preassembled retaining rod H1 is mounted, the second end section E4 protrudes from the through opening 42, beyond the support surface 26 of the base body 5, by the dimension k1, the groove 48 still being situated inside the through opening 42 (indicated by dashed lines). The retaining means 49 together with the flange 45 is gripped by hand or with a tool, and is pulled away from the support surface 26, against the elastic force of the spring element 30, thus increasing the distance k1. As soon as the groove is outside the through opening 42 during this displacement, a U-shaped wave spring 36 is inserted into the groove 48, thus securing the bolt 6*b* in the axial direction in this shown position. The wave spring 36 is supported on the support surface 26, and is held on this support surface by the elastic force of the spring element 30. FIG. 7 shows a top view B (according to FIG. 6), in which the wave spring 36 with its U-shaped cutout 41 inserted into the groove 48 can be seen.

An embodiment is also possible in which, instead of the groove 48, a through hole (not shown) is provided in the retaining means 49, through which a bolt can be inserted in order to fix the bolt 6*c* in a detent position. The bolt would then extend beyond the retaining means 49 and the opening 42 in the installed position.

The further exemplary embodiment shown in FIGS. 8 and 9 corresponds essentially to the examples in FIGS. 5 and 6, except for the region of the second end section E4, and therefore the same components are not discussed in greater detail, and reference is made to the embodiments described above. In contrast to the embodiments in the example according to FIGS. 5 and 6, the exemplary embodiment in FIG. 8 has a second end section E4 of a bolt 6*c* having a cylindrical section with a circular cross-sectional area 25 having a diameter d, the cylindrical section being provided with outwardly protruding ribs N on two opposite sides. As is apparent from the sectional illustration B-B in FIG. 9, the external dimension 12 constituted by the two ribs N is smaller than the length dimension 11 of an elongated hole-shaped cross-sectional region 21 (elongated hole for short) of a through opening 19 in the base body 5, which has a central, circular cross-sectional region 20. The elongated hole-shaped cross-sectional region 21 extends beyond the circular cross-sectional region on both sides by the dimension s, and has a width b1 that is smaller than the diameter d1 of the circular cross-sectional region 20. The ribs N have a width b2 that is smaller than the width b1 of the narrow side of the elongated hole 21. Due to the provided dimensions of the second end section E4 of the bolt 6*c* and of the through opening 19, it is possible to pass this end section E4 through the through opening 19 during installation, as described in greater detail below. The cross-sectional shape of the through opening 19 corresponds to the through opening 12 in the exemplary embodiment according to FIG. 3. For this reason, the same reference numerals have been used for the illustration of the through opening 19 as for the through opening 12 in FIG. 3. Likewise, the end section E4 corresponds to the end section E1 shown in FIG. 3. Therefore, the same reference numerals have been used for the first end section E3 shown in FIG. 8 as for the end section E1 in FIG. 3.

Grooves V (depressions) are provided at the start of the through opening 19, in the area of the support surface 26 of the base body 5, which are offset by 90° with respect to the elongated hole 21, and which with the ribs form a detent position in the position shown (FIG. 8, FIG. 9).

The preassembly of the bolt 6*c*, the retaining element 10*a*, and the spring element 31 (wave spring) together with the retaining rod H1 of the comb element K1 takes place as in the exemplary embodiment in FIG. 5 described above. After the preassembled retaining rod H1 is mounted, the second end section E4 protrudes into the through opening 19, the ribs N of the end section E3 being oriented corresponding to the cross-sectional shape of the through opening 19 (indicated by dashed lines in FIG. 8). The bolt 6*c* is gripped, using a tool by means of which a detachable connection to the end section E3 may be established via a threaded hole 29, for example, and is pulled out of the through opening 19, against the elastic force of the spring element 31, into a position indicated by dashed lines. The bolt 6*c* is then rotated by 90° (see double arrow) until the ribs N are situated above the grooves V. After the tool is released, the ribs N are transferred into a shown locking position in the grooves V due to the elastic force that is built up during the displacement of the bolt. The retaining rod H1 is now braced and secured against the circumferential surface U of the base body 5 under the effect of the elastic force of the spring elements 31 (30). Additional means may also be mounted on the second end section E4 (FIG. 8), which here as well allow a longitudinal displacement of the bolt 6*c* by hand.

Modifications and variations can be made to the embodiments illustrated or described herein without departing from the scope and spirit of the invention as set forth in the appended claims.

The invention claimed is:

1. A circular comb of a combing machine, comprising:

a base body oriented parallel to a rotational axis of the circular comb, the base body comprising an inner support surface and a radially oriented opening;

at least one comb element disposed on an outer circumference of the base body;

at each comb element, the base body further comprising a first depression oriented parallel to the rotational axis of the circular comb, and a second depression defined in a bottom surface of the first depression, the radially oriented opening defined through the base body into the second depression;

a retaining element connected to the comb element, by which the comb element is held on the outer circumference of the base body, the retaining element extending through the first depression and into the second depression;

a bolt-shaped fastening element that braces the retaining element against the base body, the fastening element comprising a first end section that protrudes at least partially into the retaining element, a middle section adjoining the first end section that protrudes at least partially into the opening in the base body, and a second end section adjoining the middle section and supported on the support surface, the second end section extending beyond a cross-sectional area of the opening in the base body;

a spring element configured with the middle section of the fastening element, the spring element comprising a first end supported on a support surface of the second end section of the fastening element facing the middle section and a second end supported on the support surface of the base body; and the retaining element comprising a detent point into which the first end section of the fastening element is transferred by a longitudinal displacement of the fastening element against an elastic force of the spring element.

2. The circular comb according to claim 1, wherein the retaining element comprises a hollow body having a web situated opposite from the base body and a through opening with an elongated cross sectional area that corresponds in shape to and extends beyond a largest cross-sectional shape of the first end section of the fastening element, and receptacles provided within the hollow body that are offset at an angle of rotation with respect to a longitudinal direction of the through opening, the receptacles defining detents at the detent point for the first end section of the fastening element.

3. The circular comb according to claim 2, wherein a cross-sectional area of the opening in the base body extends beyond the largest cross-sectional area of the first end section of the fastening element.

4. The circular comb according to claim 1, wherein the middle section of the fastening element comprises a radially outwardly extending collar with an outer diameter greater than a diameter of the opening in the base body such that the fastening element is captively held in the base body.

5. A circular comb of a combing machine, comprising:

a base body oriented parallel to a rotational axis of the circular comb, the base body comprising an inner support surface and a radially oriented opening;

at least one comb element disposed on an outer circumference of the base body;

a retaining element connected to the comb element, by which the comb element is held on the outer circumference of the base body;

a bolt-shaped fastening element that braces the retaining element against the base body, the fastening element comprising a first end section that protrudes at least partially into the retaining element, a middle section adjoining the first end section that protrudes at least partially into the opening in the base body, and a second end section adjoining the middle section and supported on the support surface, the second end section extending beyond a cross-sectional area of the opening in the base body;

wherein the retaining element comprises a hollow body having a web situated opposite from the base body and a through opening, the middle section of the fastening element protruding into the through opening;

a spring element configured with the middle section of the fastening element, the spring element comprising a first end supported on a support surface of the first end section of the fastening element and a second end supported on a support surface of the web within the hollow body;

the second end section of the fastening element fixed in a locked position relative to the support surface of the base body by a retaining device against longitudinal displacement of the fastening element from an elastic force of the spring element;

the base body comprising circumferentially extending and spaced-apart support ribs on which ends of the comb elements rest, the support ribs extending parallel to the rotational axis of the circular comb and defining a first depression in the base body that extends parallel to the rotational axis of the circular comb; and the retaining element extending through the first depression and into a second depression defined in a bottom surface of the first depression.

6. The circular comb according to claim 5, wherein the retaining device is detachably connected to the second end section of the fastening element and extends beyond a cross-sectional area of the opening in the base body.

7. The circular comb according to claim 6, wherein the second end section of the fastening element comprises a threaded bolt with an outer diameter that is smaller than a diameter of the middle section, the retaining device comprising a threaded nut engaged on the threaded bolt.

8. The circular comb according to claim 6, wherein the second end section of the fastening element comprises a circumferential groove, the retaining device engaging in the circumferential groove.

9. The circular comb according to claim 5, wherein the spring element comprises a coil spring or a wave spring.

10. The circular comb according to claim 5, wherein the base body comprises a recess into which the retaining element radially protrudes.

11. The circular comb according to claim 5, wherein the retaining element is made at least partially of plastic.

12. The circular comb according to claim 5, wherein the retaining element is formed as one piece with the comb element.

13. The circular comb according to claim 5, wherein the fastening element is made at least partially of plastic.

14. A combing machine, comprising a circular comb according to claim 1.

15. A combing machine, comprising a circular comb according to claim 5.

* * * * *